US007458461B2

(12) United States Patent
Hara et al.

(10) Patent No.: US 7,458,461 B2
(45) Date of Patent: Dec. 2, 2008

(54) PACKAGING APPARATUS AND METHOD FOR COMPRESSOR

(75) Inventors: Masayuki Hara, Ota (JP); Masazumi Sakaniwa, Ota (JP); Takao Kanayama, Ora-Gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 442 days.

(21) Appl. No.: 11/389,288

(22) Filed: Mar. 24, 2006

(65) Prior Publication Data

US 2006/0222542 A1 Oct. 5, 2006

(30) Foreign Application Priority Data

Mar. 31, 2005 (JP) ..... 2005-103002
Mar. 31, 2005 (JP) ..... 2005-103003

(51) Int. Cl.
*B65D 85/68* (2006.01)

(52) U.S. Cl. ..... 206/319; 206/485; 206/488; 206/594

(58) Field of Classification Search ..... 206/319, 206/485, 486, 488, 521, 588, 589, 591, 592, 206/594; 53/472, 473
See application file for complete search history.

(56) References Cited

U.S. PATENT DOCUMENTS 4,033,455 A * 7/1977 Robison ..... 206/391
4,848,563 A * 7/1989 Robbins ..... 206/315.9
4,875,580 A 10/1989 Stringer et al.
4,892,196 A * 1/1990 Okajima ..... 206/523
5,743,393 A * 4/1998 Webb et al. ..... 206/319
6,092,654 A * 7/2000 Webb ..... 206/320
6,126,002 A * 10/2000 Brown et al. ..... 206/320
2005/0121345 A1 * 6/2005 Cho ..... 206/386

FOREIGN PATENT DOCUMENTS

DE 40 19 205 A1 12/1991
FR 2 807 738 A1 10/2001
JP 6-255674 A 9/1994
JP 10-218275 A 8/1998

OTHER PUBLICATIONS

Patent Abstracts of Japan for JP06 255674 published on Sep. 13, 1994.

* cited by examiner

*Primary Examiner*—Jacob K. Ackun, Jr.
(74) *Attorney, Agent, or Firm*—Darby & Darby

(57) ABSTRACT

A compressor packaging apparatus for fixing plural compressors each of which has dish-shaped end caps at both the upper and lower end portions of a cylindrical compressor body, including an upper plate and a lower plate between which the compressors are sandwiched and fixed, the lower plate being equipped with a plurality of stepped fitting portions in which the lower end caps of the compressors are fitted, and first paper pipes fitted to the stepped fitting portions. Furthermore, an intermediate plate having plural insertion holes in which the compressor bodies are inserted is provided, and second paper pipes fitted to the end caps at the upper portions of the compressors and third paper pipes may be provided between the upper plate and the intermediate plate.

14 Claims, 6 Drawing Sheets

PACKAGING APPARATUS AND METHOD FOR COMPRESSOR

BACKGROUND OF THE INVENTION

1. Field of the Invention

The present invention relates to apparatus and method for packaging compressors when plural compressors are transported, stored, etc.

2. Description of the Related Art

A compressor is generally designed so that dish-like end caps are provided to both the end portions of a cylindrical compressor body, and a connection terminal is provided to one end cap so as to project from the end cap concerned while a fixing board is provided to the other end cap as disclosed in JP-A-6-255674. In the case of a packaging apparatus for the compressor disclosed in JP-A-6-255674, the fixing board is provided to the end cap at the lower portion of the compressor, and thus the compressor can be pinched between a lower plate and an upper plate under a stable state by directly fixing the fixing board to the lower plate or engagedly fitting the fixing board to the lower plate.

However, with respect to a compressor having no fixing board at the end cap and a horizontal set type compressor in which a fixing board is provided to the peripheral side surface of the compressor body, it is difficult to package the compressor under the state that the compressor stands stably.

Furthermore, with this type of packaging apparatus, plural compressors are pinched and fixed by the lower plate and the upper plate as disclosed in JP-A-10-218275, for example. In the compressor packaging apparatus disclosed in JP-A-10-218275, the fixing board is provided to the end cap at the lower portion of the compressor, and thus it is possible to pinch the compressor between the lower plate and the upper plate under a stable state by directly fixing the fixing board to the lower plate or engagedly fitting the fixing board to the lower plate.

However, with respect to the compressor having no fixing board at the end cap and the horizontal set type compressor in which a fixing board is provided to the peripheral side surface of the compressor body, these compressors are unstable when they are transported, and there is a risk that the welded portion between the compressor body and the end cap, etc. are damaged by vertical vibration or waggling.

SUMMARY OF THE INVENTION

The present invention has been implemented in view of the foregoing situation, and has an object to provide packaging apparatus and method with which even a compressor having no fixing board at an end cap thereof and a horizontal set type compressor having a fixing board provided to the peripheral surface side of the main body of the compressor can be packaged under the state that the compressors are stably raised.

Furthermore, the present invention has another object to provide packaging apparatus and method with which a compressor having no fixing board at an end cap thereof and a horizontal set type compressor having a fixing board provided to the peripheral surface side of the main body of the compressor can be prevented from being damaged due to vertical vibration or waggling when the compressors are transported.

In order to attain the above object, according to a first aspect of the present invention, a compressor packaging apparatus for fixing plural compressors each of which has dish-shaped end caps at both the upper and lower end portions of a cylindrical compressor body, comprises an upper plate and a lower plate between which the compressors are sandwiched and fixed, the lower plate being equipped with a plurality of stepped fitting portions in which the lower end caps of the compressors are fitted, and first paper pipes fitted to the stepped fitting portions.

In the compressor packaging apparatus, each of the lower end caps has a flat portion, and the compressors are mounted on the lower plate so that the flat portions of the lower end caps are supported by the first paper pipes.

The compressor packaging apparatus further comprises second paper pipes that are covered on the upper end caps of the upper portions of the compressors so that the upper portions of the second paper pipes are regulated by the upper plate.

In the compressor packaging apparatus, a fixing board is provided to the peripheral side surface of each of the compressor bodies, an intermediate plate having plural insertion holes in which the compressor bodies are inserted is provided between the lower plate and the upper plate, and third paper pipes are disposed between the intermediate plate and the upper plate.

According to a second aspect of the present invention, a compressor packaging apparatus for sandwiching between a lower plate and an upper plate plural compressors each of which is provided with dish-shaped end caps at both the end portions of a cylindrical compressor body and also provided with a fixing board on the peripheral side surface of the compressor body is characterized in that the lower plate is provided with plural stepped fixing portions in which one end cap of each of the compressors is fitted, an intermediate plate having plural insertion holes in which the compressor bodies are inserted is provided, and plural recess portions that are fitted to the fixing boards of the compressors to restrict turning of the compressors are provided on the lower surface of the intermediate.

In the compressor packaging apparatus, each of the plural recess portions is designed to have a shape imitating the shape of the fixing board.

In the compressor packaging apparatus, a paper pipe is covered on the end cap at the upper portion of each of the compressors so that the upper portion of the paper pipe is regulated by the upper plate.

The compressor packaging apparatus further comprises a first paper pipe fitted in each of the fitting portions of the lower plate, a second paper pipe covered on the end cap at the upper portion of each of the compressors so that the upper portion of the second paper pipe is regulated by the upper plate, and a third paper disposed between the intermediate plate and the upper plate.

In the compressor packaging apparatus, the lower plate is formed by attaching plural corrugated boards.

In the compressor packaging apparatus, the upper plate is formed of plywood.

According to a third aspect of the present invention, a compressor packaging method of sandwiching between a lower plate and an upper plate plural compressors each of which is provided dish-shaped end caps at both end portions of a cylindrical compressor body, thereby fixing the compressors, comprises the step of supporting one end cap of each of the compressors by a first paper pipe fitted in each of plural stepped fitting portions of the lower plate.

In the compressor packaging method, each end cap has a flat portion, and the compressors are packaged while each flat portion is supported by each first paper pipe.

In the compressor packaging method, second paper pipes whose upper portions are regulated by the upper plate is provided, and the compressors are packaged while the second paper pipes are covered on the end caps at the upper portions of the compressors.

In the compressor packaging method, the compressors are packaged while the compressor bodies are inserted in plural insertion holes formed in an intermediate plate between the lower plate and the upper plate, and third papers are disposed between the upper plate and the intermediate plate.

DETAILED DESCRIPTION OF THE PREFERRED EMBODIMENTS

Preferred embodiments according to the present invention will be described hereunder with reference to the accompanying drawings.

Figure 2:
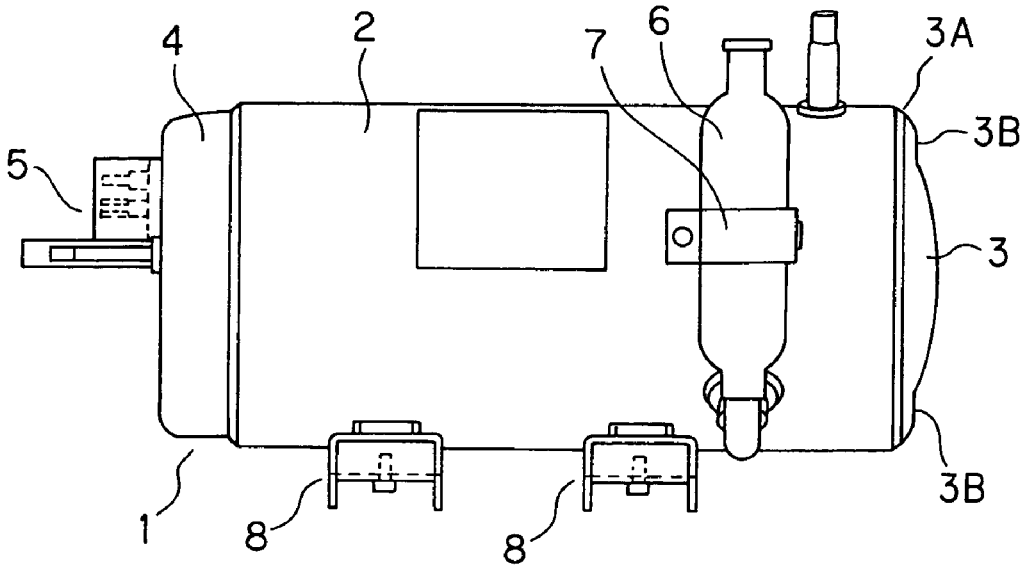
FIG. 2 is a front view showing the compressor.
Figure 3:
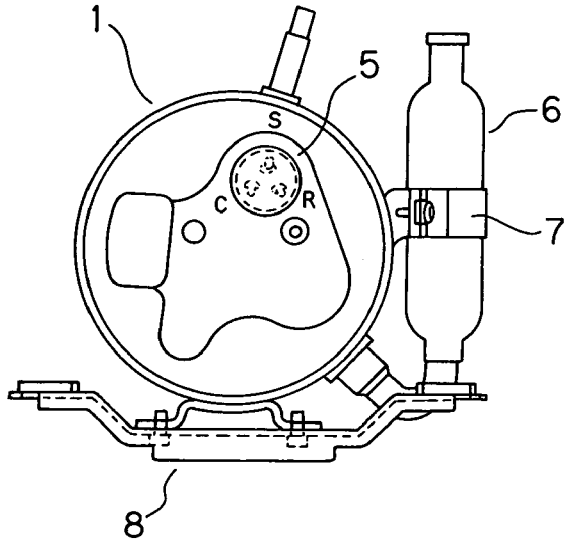
FIG. 3 is a left side view of the compressor.

A compressor 1 is designed so that dish-shaped end caps 3 and 4 are fixed to both the ends of a cylindrical compressor body 2 by welding as shown in FIGS. 2 and 3. An annular flat portion 3B is provided in the vicinity of the peripheral edge portion 3A serving as a welding portion of the end cap 3. A connection terminal 5 is provided to the end cap 4 so as to project from the end cap 4. An accumulator 6 is connected to the compressor body 2, and it is held on the compressor body 2 by a fixing band 7. Two fixing boards 8 are provided to the lower portion on the peripheral side surface of the compressor body 2. Accordingly, the compressor 1 is designed as a horizontal set type compressor that is fixed to a machine house of an air conditioner or the like.

Figure 1:
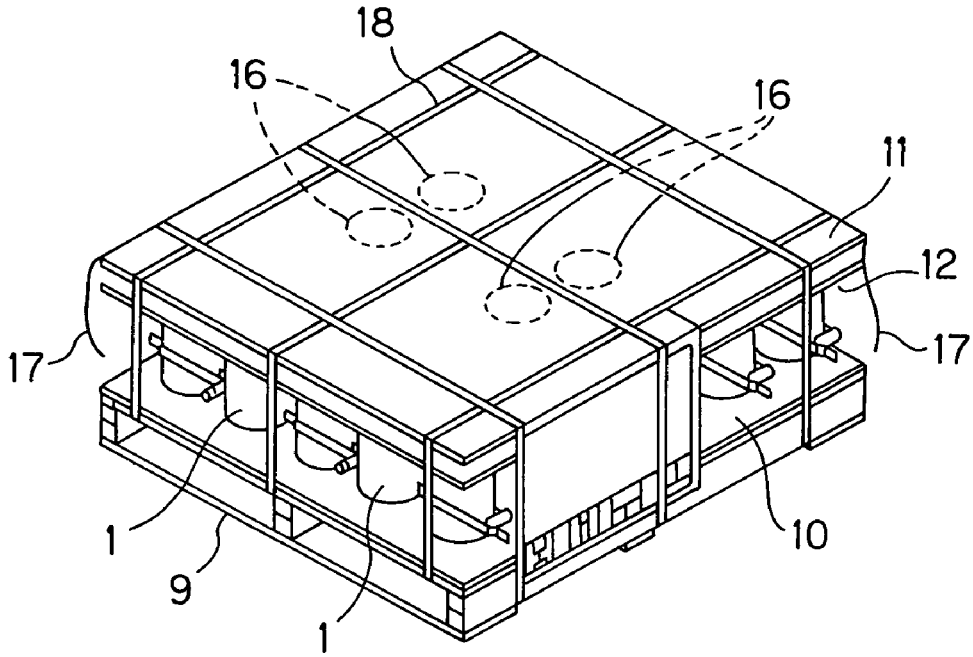
FIG. 1 is a perspective view showing a packaging apparatus for a compressor.
Figure 4:
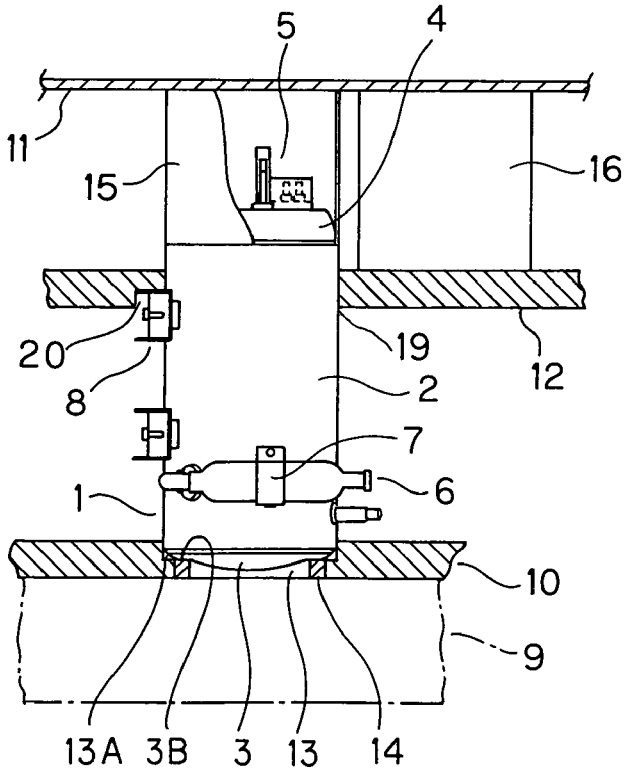
FIG. 4 is a cross-sectional view showing the main part of the packaging apparatus for the compressor.
Figure 5:
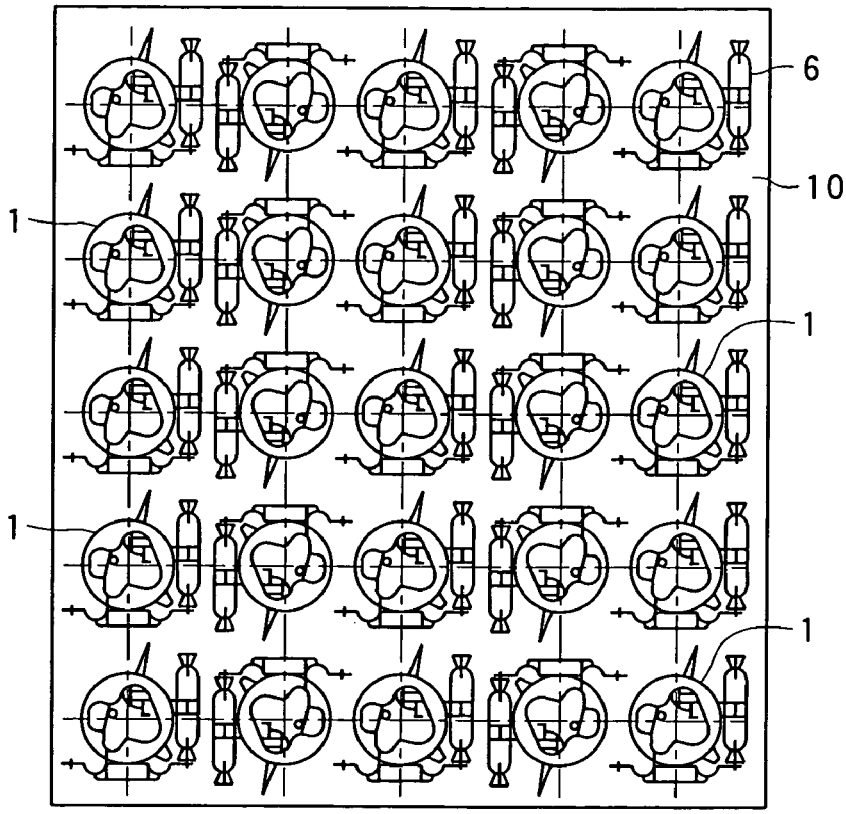
FIG. 5 is a plain view showing a state where the compressor is mounted on a lower plate.
Figure 6:
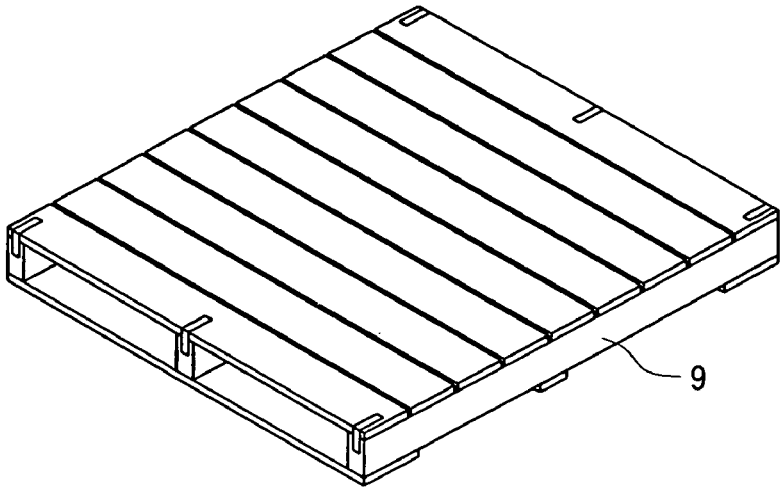
FIG. 6 is a perspective view showing a base table.
Figure 7:
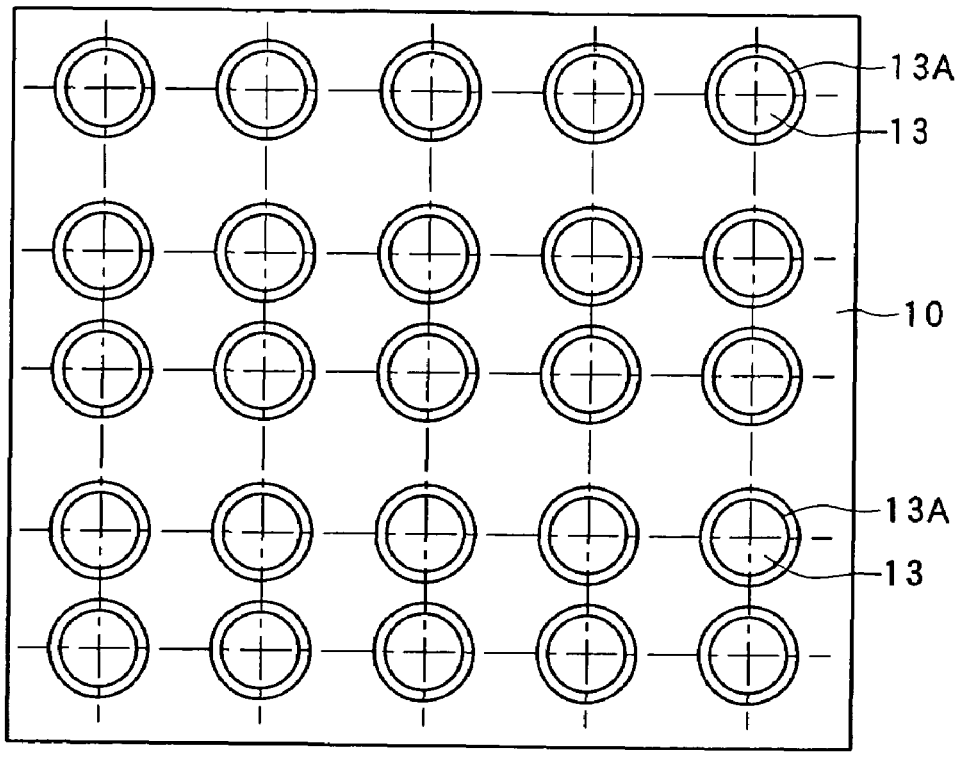
FIG. 7 is a plan view showing the lower plate.
Figure 8:
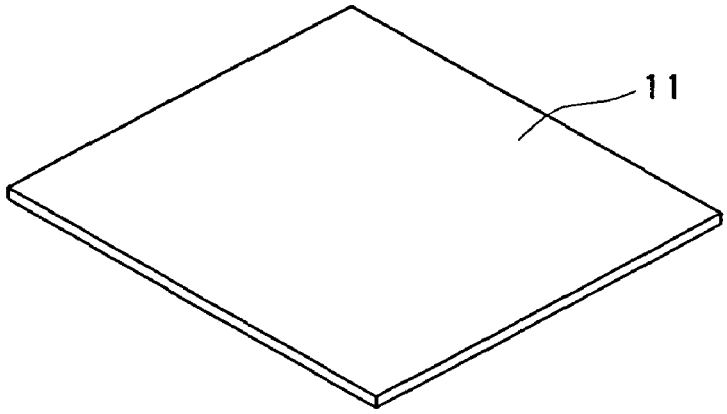
FIG. 8 is a plan view showing an upper plate.
Figure 10:
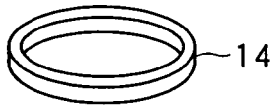
FIG. 10 is a perspective view showing a first paper pipe.
Figure 11:
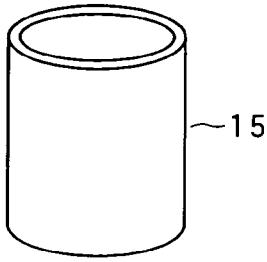
FIG. 11 is a perspective view showing a second paper pipe.
Figure 12:
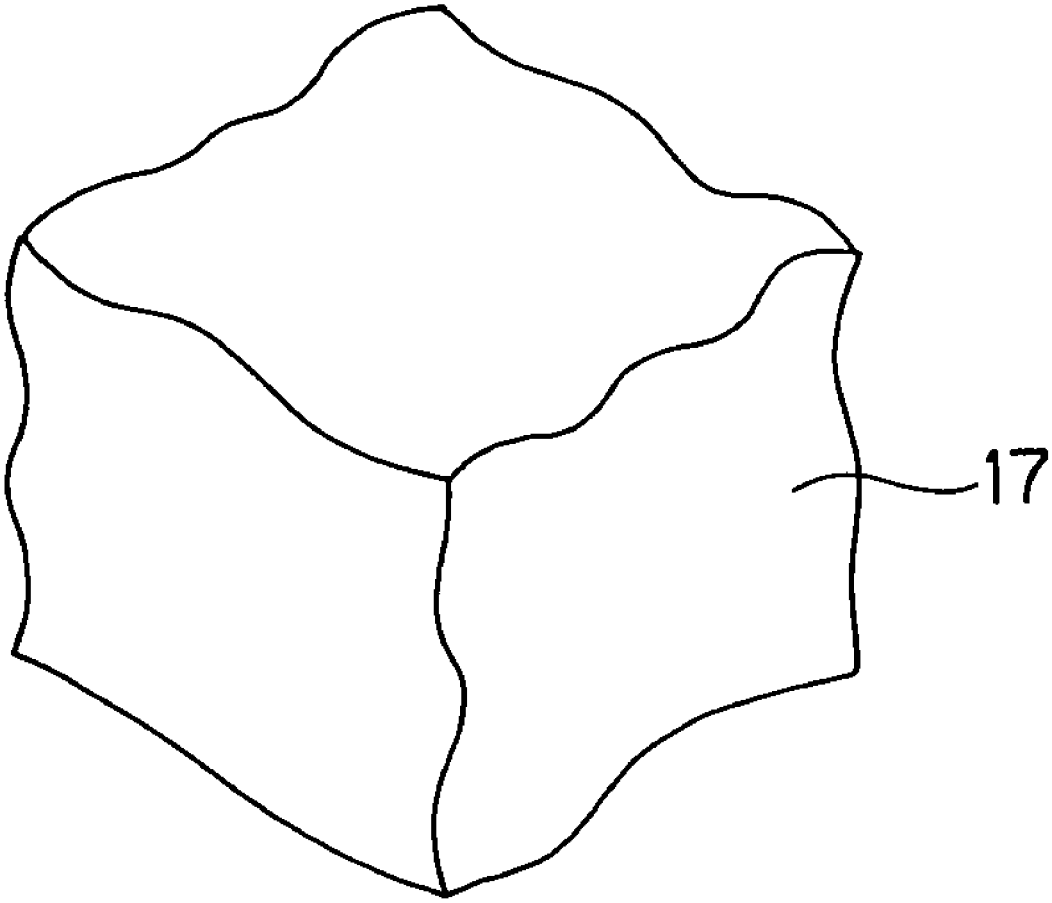
FIG. 12 is a perspective view showing the main part of a plastic sheet.

Twenty five compressors 1 each of which has the above construction are packaged as one set in a lump. As shown in FIGS. 1 and 4, a packaging apparatus for one set of compressors 1 is mainly equipped with a base table (see FIG. 6) 9 such as a pallet or the like which is formed of a wood frame and into which arms of a forklift are insertable, a lower plate 10 (see FIG. 7) which is mounted on the base table 9 and formed by bonding plural corrugated boards, an upper plate 11 (see FIG. 8) formed of laminated wood (plywood), an intermediate plate 12 (see FIG. 9) which is formed by bonding plural corrugated boards and in which the compressor bodies 2 are inserted, hollow cylindrical first paper pipes 14 (see FIG. 10) fitted in respective stepped engaging holes (stepped fitting portions) that are formed in the lower plate 10 and have a circular shape in plan view, hollow cylindrical second paper pipes 15 (see FIG. 11) each of which covers the end cap 4, is sandwiched between the compressor body 2 and the upper plate 11 and whose upper portion is regulated by the upper plate 11, hollow cylindrical third paper pipes 16 which are sandwiched between the intermediate plate 12 and the upper plate 11 so as to be located among the plural compressors (four places), a waterproof and dustproof plastic sheet 17 (see FIG. 12) which covers the above elements and has one open surface, and a fastening band 18 for fastening the above elements integrally.

Figure 9:
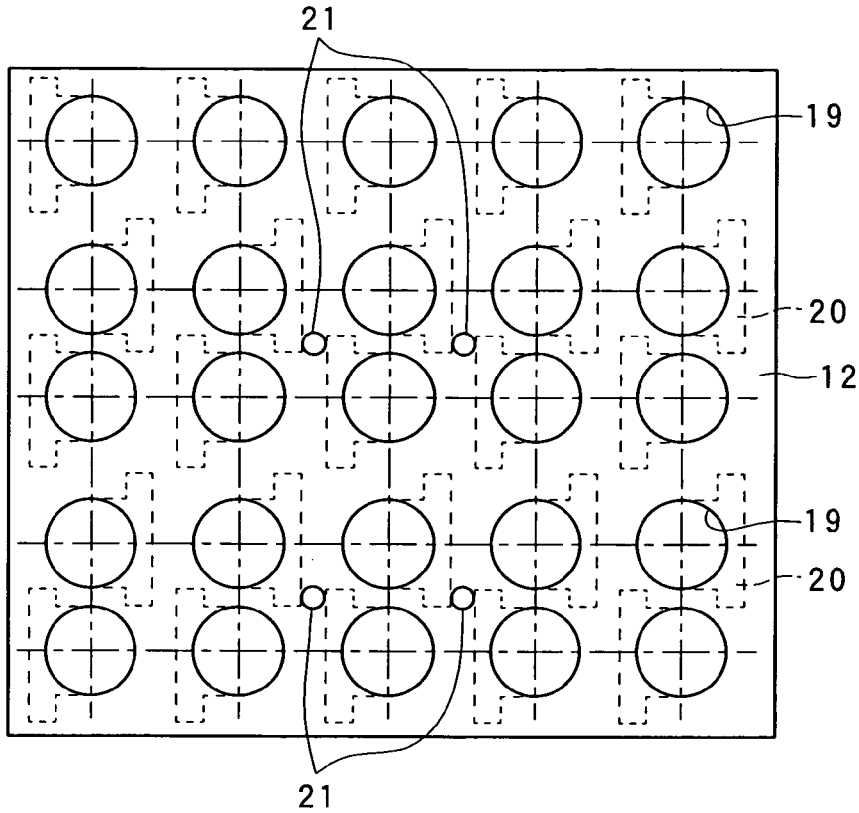
FIG. 9 is a plan view showing an intermediate plate.

As shown in FIGS. 4 and 9, recess portions 20 each of which has the shape corresponding to the fixing board 8 of each compressor 1 are formed on the lower surface of the intermediate plate 12 so as to be continuous with insertion holes 19 for the compressor bodies 2. Furthermore, marks 21 indicating the set places of the third paper pipes 16 are provided at four places on the upper surface of the intermediate plate 12.

In the above-described packaging apparatus for the compressors, the lower plate 10 which has substantially the same size as the base table 9 is first mounted on the base table 9, and the first paper pipes 15 are fitted into the stepped fitting holes 13 of the lower plate 10. Then, the end gap 3 of the compressor 1 is fitted into the stepped fitting holes 13. At this time, the flat portion 3B of each end gap 3 abuts against the step portion 13A of each stepped fitting hole 13 and the upper end portion of each paper pipe 14. Subsequently, the intermediate plate 12 is covered on the compressors 1 from the upper side thereof, and the compressor bodies 2 are inserted into the insertion holes 19 of the intermediate plate 12. In addition, the recess portions 20 of the intermediate plate 12 are fitted to the fixing boards 8 of the compressors 1 (see FIG. 4). The fitting between each recess portion 20 of the intermediate plate 12 and each fixing board 8 regulates each compressor 1 so that the compressor 1 is not rotated, so that the rotation in the plane direction of the compressor 1 can be prevented.

Subsequently, the second paper pipes 15 are covered on the end caps 4 of the compressors 1 from the upper side thereof, and the four third paper pipes 16 are put at the positions indicated by the marks 21 of the intermediate plate 12 with avoiding the compressors 1. Subsequently, the upper plate 11 is put on the compressors 1, a plastic sheet 17 formed of polyethylene or the like is covered on the upper plate 11 and then the assembly of these elements is fastened by the fastening band 18. Furthermore, the height of each paper pipe 14 is set so that the upper end portion of the paper pipe 14 is located on the same plane as the step portion 13A. The above-described elements may be assembled under the state that the paper pipes 14 are installed in the lower plate 10 in advance, and the same is also applied to the paper pipes 15 and 16.

In the compressor packaging apparatus thus constructed, the end cap 3 of the lower portion of each compressor 1 is engagedly fitted in each stepped fitting hole 13 of the lower plate 10, so that not only the compressor 1 is stably held when transported, but also the flat portion 3B (not the welding portion) of the end gap 3 of the lower portion of the compressor 1 is supported by the step portion 13A of each stepped fitting hole 13. Therefore, even when the compressors 1 are vibrated in the vertical direction, the welding portion between the compressor body 2 and the end cap 3 is prevented from suffering a large load. Furthermore, the paper pipes 14 are fitted in the stepped fitting hole 13, and thus the paper pipes 14 are liable to be crushed when vertical vibration is applied, so that the compressors 1 can be protected by the buffer action of the paper pipes 14.

Furthermore, even in the horizontal set type compressor 1 in which the fixing board 8 is provided to the peripheral side surface of the compressor body 2, the recess portion having the shape imitating the shape of the fixing board 8 is provided to the lower surface of the intermediate plate 12 in which the compressor body 2 is inserted. Therefore, the action of preventing the rotation (turning) of the compressor (i.e., the detent action of the compressor) is achieved, and thus the waggling of the compressor 1 can be prevented when it is transported. In this case, for example when the compressor 1 is fixed to the machine housing of an air conditioner or the like, it is unnecessary to provide a special metal fitting for preventing the rotation (turning) of the compressor.

Furthermore, the paper pipes 15, 16 are provided between the intermediate plate 12 and the upper plate 11. Therefore, the connection terminals projected from the end caps 4 of the upper portions of the compressors 1 can be protected by the paper pipes 15, and also the intermediate plate 12 can be prevented from riding up due to vertical vibration and thus dropping off the compressor bodies 2 by the paper pipes 16. Therefore, the compressors 1 can be surely prevented from being damaged due to vertical vibration or waggling when they are transported.

As described above, according to this embodiment, in a compressor in which no fixing board is provided to the end cap or in a horizontal set type compressor in which a fixing board is provided to the peripheral side surface of the compressor body, the end cap of the lower portion of the compressor is fitted to the stepped fitting portion of the lower plate, and the compressor can be stably held when transported. In addition, the portion of the end cap of the lower portion of the compressor which does not correspond to the welding portion is supported by the step portion of the stepped fitting portion, so that no large load is imposed on the welding portion between the compressor body and the end cap due to vertical vibration. Furthermore, the first paper pipe is fitted to the fitting portion of the lower plate. Therefore, the paper pipes are liable to be crushed when vertical vibration is applied, and thus the compressors can be protected by the buffer action of the paper pipes.

Furthermore, the plural recess portions each of which has the shape imitating the shape of the fixing board of each compressor are provided on the lower surface of the intermediate plate in which the compressor bodies are inserted. Therefore, the waggling of the compressors can be prevented during transportation, so that the compressors can be prevented from being damaged.

Still furthermore, in the horizontal set type compressor in which the fixing board is provided to the peripheral side surface of the compressor body, the second paper pipes and the third paper pipes are further provided between the intermediate plate and the upper plate. Therefore, in addition to the above effect, the connection terminal projected from the end cap of the upper portion of each compressor can be protected by the paper pipe, and also the intermediate plate can be prevented from riding up due to vertical vibration and thus dropping off the compressor body 2 by the paper pipe. Therefore, the compressors can be more surely prevented from being damaged due to vertical vibration or waggling when transported.

Various alternatives, corrections or modifications may be made to the above-described embodiment on the basis of the foregoing description by persons skilled in the art, and the present invention contains the various alternatives, corrections or modifications described above without departing from the subject matter of the present invention. For example, the compressors may be vertically stacked at plural stages and integrally packaged by using the lower plates, the upper plates, the intermediate plates and the paper pipes.

What is claimed is:

1. A compressor packaging apparatus for fixing plural compressors each of which has dish-shaped end caps at both the upper and lower end portions of a cylindrical compressor body, comprising:

an upper plate and a lower plate between which the compressors are sandwiched and fixed, the lower plate being equipped with a plurality of stepped fitting portions in which the lower end caps of the compressors are fitted; and first paper pipes fitted to the stepped fitting portions.

2. The compressor packaging apparatus according to claim 1, wherein each of the lower end caps has a flat portion, and the compressors are mounted on the lower plate so that the flat portions of the lower end caps are supported by the first paper pipes.

3. The compressor packaging apparatus according to claim 1, further comprising second paper pipes that are covered on the upper end caps of the upper portions of the compressors so that the upper portions of the second paper pipes are regulated by the upper plate.

4. The compressor packaging apparatus according to claim 1, wherein a fixing board is provided to the peripheral side surface of each of the compressor bodies, an intermediate plate having plural insertion holes in which the compressor bodies are inserted is provided between the lower plate and the upper plate, and third paper pipes are disposed between the intermediate plate and the upper plate.

5. A compressor packaging apparatus for sandwiching between a lower plate and an upper plate plural compressors each of which is provided with dish-shaped end caps at both the end portions of a cylindrical compressor body and also provided with a fixing board on the peripheral side surface of the compressor body, wherein the lower plate is provided with plural stepped fixing portions in which one end cap of each of the compressors is fitted, an intermediate plate having plural insertion holes in which the compressor bodies are inserted is provided, and plural recess portions that are fitted to the fixing boards of the compressors to restrict turning of the compressors are provided on the lower surface of the intermediate plate.

6. The compressor packaging apparatus according to claim 5, wherein each of the plural recess portions is designed to have a shape imitating the shape of the fixing board.

7. The compressor packaging apparatus according to claim 6, wherein a paper pipe is covered on the end cap at the upper portion of each of the compressors so that the upper portion of the paper pipe is regulated by the upper plate.

8. The compressor packaging apparatus according to claim 5, further comprising a first paper pipe fitted in each of the fitting portions of the lower plate, a second paper pipe covered on the end cap at the upper portion of each of the compressors so that the upper portion of the second paper pipe is regulated by the upper plate, and a third paper disposed between the intermediate plate and the upper plate.

9. The compressor packaging apparatus according to claim 1, wherein the lower plate is formed by attaching plural corrugated boards.

10. The compressor packaging apparatus according to claim 1, wherein the upper plate is formed of plywood.

11. A compressor packaging method of sandwiching between a lower plate and an upper plate plural compressors each of which is provided dish-shaped end caps at both end portions of a cylindrical compressor body, thereby fixing the compressors, comprising the step of:

supporting one end cap of each of the compressors by a first paper pipe fitted in each of plural stepped fitting portions of the lower plate.

12. The compressor packaging method according to claim 11, wherein each end cap has a flat portion, and the compressors are packaged while each flat portion is supported by each first paper pipe.

13. The compressor packaging method according to claim 11, wherein second paper pipes whose upper portions are regulated by the upper plate is provided, and the compressors are packaged while the second paper pipes are covered on the end caps at the upper portions of the compressors.

14. The compressor packaging method according to claim 11, wherein the compressors are packaged while the compressor bodies are inserted in plural insertion holes formed in an intermediate plate between the lower plate and the upper plate, and third papers are disposed between the upper plate and the intermediate plate.

* * * * *